US006439418B1

(12) United States Patent
Immerman et al.

(10) Patent No.: US 6,439,418 B1
(45) Date of Patent: Aug. 27, 2002

(54) ATTACHING SYSTEM FOR A CONTAINER AND A BASE

(75) Inventors: Robert A. Immerman, Shaker Heights; Philip C. Dretzka, Cleveland Heights, both of OH (US)

(73) Assignee: InterDesign, Inc., Bolon, OH (US)

( * ) Notice: Subject to any disclaimer, the term of this patent is extended or adjusted under 35 U.S.C. 154(b) by 0 days.

(21) Appl. No.: 09/812,626

(22) Filed: Mar. 20, 2001

(51) Int. Cl.[7] ..... B65D 25/24
(52) U.S. Cl. ..... 220/630; 220/626; 220/636
(58) Field of Search ..... 220/630, 625, 220/626, 627, 628, 636; 215/392, 393; 248/310, 311.2, 346.11, 346.5

(56) References Cited

U.S. PATENT DOCUMENTS

| | | | |
|---|---|---|---|
| 170,946 | A | 12/1875 | French |
| 2,158,230 | A | 5/1939 | Godfrey |
| 2,552,080 | A | 5/1951 | Amberg |
| 2,854,790 | A | 10/1958 | Hartung |
| 3,122,257 | A | 2/1964 | Soehrman |
| 3,142,934 | A | 8/1964 | Mehling |
| 3,653,575 | A | 4/1972 | Shrepper |
| 3,951,266 | A | 4/1976 | Brewer |
| 4,273,245 | A | 6/1981 | Machalek |
| 4,552,275 | A | 11/1985 | Chang et al. |
| 4,620,685 | A | 11/1986 | Taguchi |
| 5,234,280 | A | 8/1993 | Cowan |
| 5,285,996 | A | 2/1994 | Waller |
| 5,727,710 | A | 3/1998 | Severus et al. |
| 5,740,914 | A | 4/1998 | Herzog |
| 5,816,437 | A | 10/1998 | Lin |

*Primary Examiner*—Stephen Castellano
(74) *Attorney, Agent, or Firm*—D. Peter Hochberg; Katherine R. Vieyra; Sean Mellino

(57) ABSTRACT

A container having a container portion attached to a base portion where the container has a base section and a floor section, and the base portion has a floor supporting section, at least one protruding member extending from one of the floor sections of the container portion or the floor supporting section of the base portion and at least one receptacle for receiving the protruding member in the other of the floor section and the floor supporting section. The container has side walls has a downwardly facing shoulder for engaging an abutting surface in the base portion. The container portion is preferably made of plastic and the base portion is preferably made of metal.

20 Claims, 5 Drawing Sheets

ATTACHING SYSTEM FOR A CONTAINER AND A BASE

BACKGROUND OF THE INVENTION

1. Field of the Invention

This invention relates to the connection of two parts together, and more particularly to a container having a container portion connected to a base.

2. Description of the Prior Art

There are various situations where an upper part must be connected to a lower part to prevent rotation or other movement between the two parts, to reduce or prevent breakage of one of the parts despite them being subjected to impact and to enable the nesting of units made from the two parts and preventing jamming of the nested units. In such situations, it is advantageous to use a small number of connecting components and to require a small number of operations to make the connection to reduce the time of making the connection.

There are shortcomings in many type of such containers, such as containers used in homes, business and other areas. Present containers often tip over when sideways force is applied to them, or become unstable when heavy loads or top-heavy loads are put in the containers. Containers often break or are damaged during shipping, while in use or by being tipped over. Breakage sometimes occurs upon the container being subjected to impact, such as when the container is dropped, when a package containing the container during shipment is dropped, or by the shifting of the container in the shipping package. Containers are often nested during storage or after being constructed in order to be shipped, and jamming of the nested containers requires time to separate the containers and the possible breakage of the nested containers.

Interior ribs are sometimes used to prevent jamming, but this involves considerable expense.

There have been various connection means and various container designs which have addressed some of the foregoing problems.

Various devices are known for connecting a container portion to a base portion, for having a container portion and a base portion made of different materials, and or providing nesting containers features in the present invention described below. U.S. Pat. No. 170,946 describes a pitcher or jug having a threaded base for being screwed into a correspondingly threaded saucer. A drip-proof glass having a glass portion sitting on a base is shown in U.S. Pat. No. 2,158,230, the latter showing a bracket holding a rubber washer. U.S. Pat. No. 2,552,080 discloses a rubber holder for holding paper cups with rounded bottoms. Flowerpots with legs, which can be extended through another flowerpot when they are nested together, are described in U.S. Pat. No. 2,854,790. U.S. Pat. No. 3,122,257 shows a liquid vessel having a container held on a base which sits on a foot member to prevent the vessel from tipping even if the base is tipped.

There are several of such patents involving drinking cups. A thermoplastic drinking cup sits on a holder is described in U.S. Pat. No. 3,653,575. A thin walled cup having shoulders at its base to prevent the cups from being stuck when they are nested together is shown in U.S. Pat. No. 3,951,266. U.S. Pat. No. 4,273,245 describes an insulated glass vessel wherein the glass has a narrow lower portion which is held in a tubular polystyrene member by a thermosetting resin.

U.S. Pat. No. 4,552,275 reveals a plastic bottle centered on a base by a projection which enters a recess. A rotating mechanism for beer containers for enabling the rotation of a handle on the container is described in U.S. Pat. No. 4,620,685. A traffic-channeling device having a deformable drum over which is a part of a truck tire which serves as a stabilizing base is described in U.S. Pat. No. 5,234,280.

Referring next to U.S. Pat. No. 5,285,996, a channel member snaps over and covers the rim of a metal can to prevent the rim from gouging a support surface or for leaving rust stains.

A container made from both metal and plastic is described in U.S. Pat. No. 5,727,710. A configuration of a lid container and of the base so that they can be stacked is taught in U.S. Pat. No. 5,740,914. A similar arrangement is shown in U.S. Pat. No. 5,816,437.

SUMMARY OF THE INVENTION

It is an object of the present invention to connect an upper part to a lower part and prevent rotation or other movement between the parts.

Another object of the invention is to provide a connection system between an upper part and a lower part which protects the parts from breakage or damage when they are subjected to impact.

Yet further object is the provision of a secure system for connecting upper and lower parts made of different materials.

One general object of the invention is the provision of a connection system for an upper part and a lower part which is economical to provide and use, efficient in operation and dependable in long term use of the connected parts.

It is another object of the present invention to provide a container which is stable in operation and not being subject to being tipped over when a force is applied to the side of the container, or when the container has unstable load.

Another of the objects of the invention is to provide a means for connecting an upper container portion to a base portion which prevents rotation or other movement between the container portion and the base.

Yet a further object of the invention is a two-part container in which breakage is reduced or prevented even if impacts were to occur to the container.

An additional object of the invention is the provision of a nestable container which is not subject to jamming when the containers are nested.

Another object is to provide a container having different cross sectional shapes, including being round and oval shaped.

A still further object of the invention is to provide a two piece container having a metal base portion and a plastic upper container portion which are connected together in a secure manner.

Another object is to provide a plastic container having a greater than expected weight, providing a greater perceived value by the consumer Still yet a further object of the invention is the provision of a container which can be shipped in bulk and not be subject to breakage.

A second general object of the invention is the provision of a container made of more than one piece which are connected together in efficient and effective manner, and which is economical to manufacture, and effective in use. These and other objects will be apparent from the description to follow and from the appended claims.

DESCRIPTION OF THE PREFERRED EMOBIDMENTS OF THE INVENTION

Figure 1:
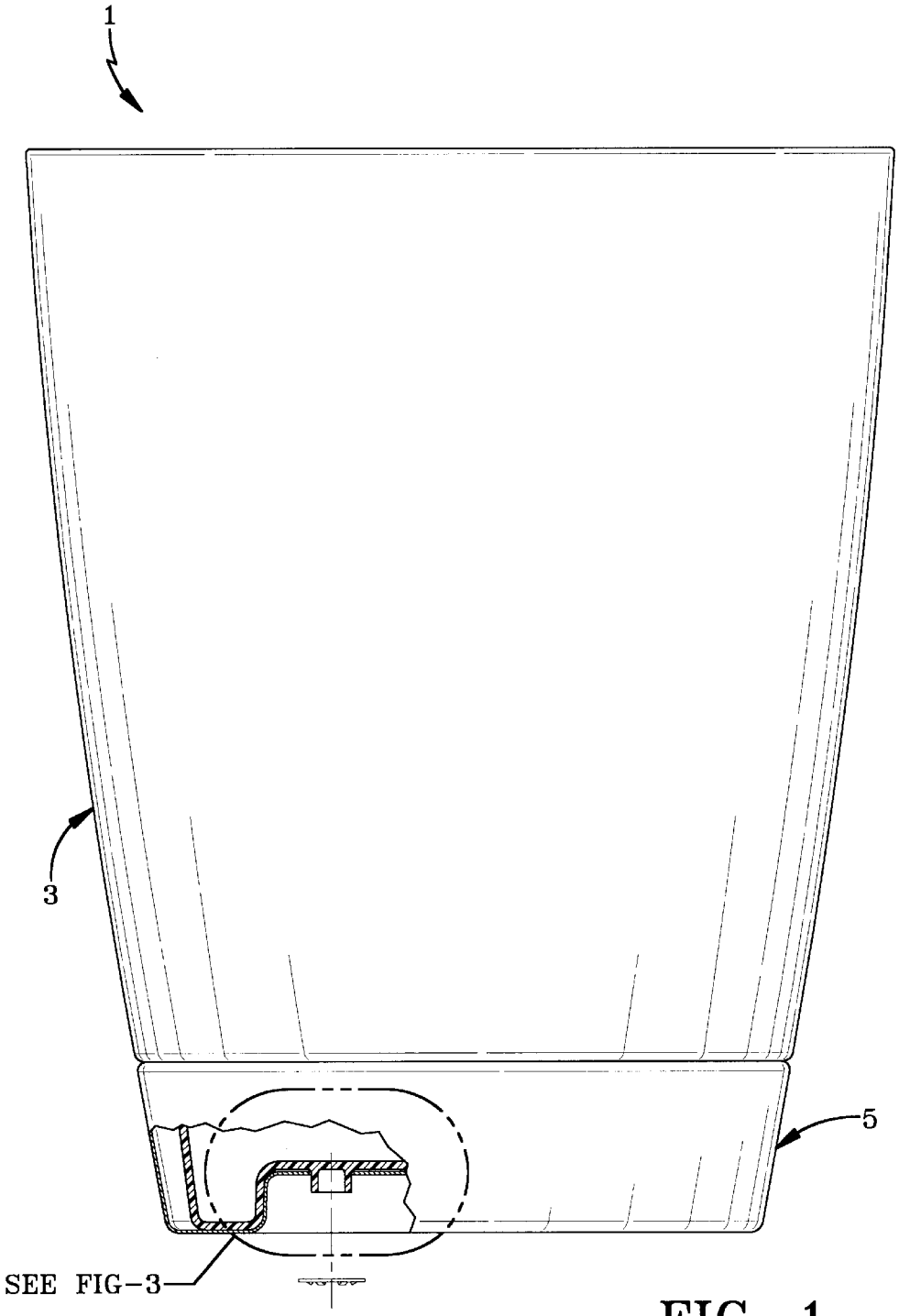
FIG. 1 is a side view of a container according to the invention, with a portion cut away to show an interior part of the container
Figure 2:
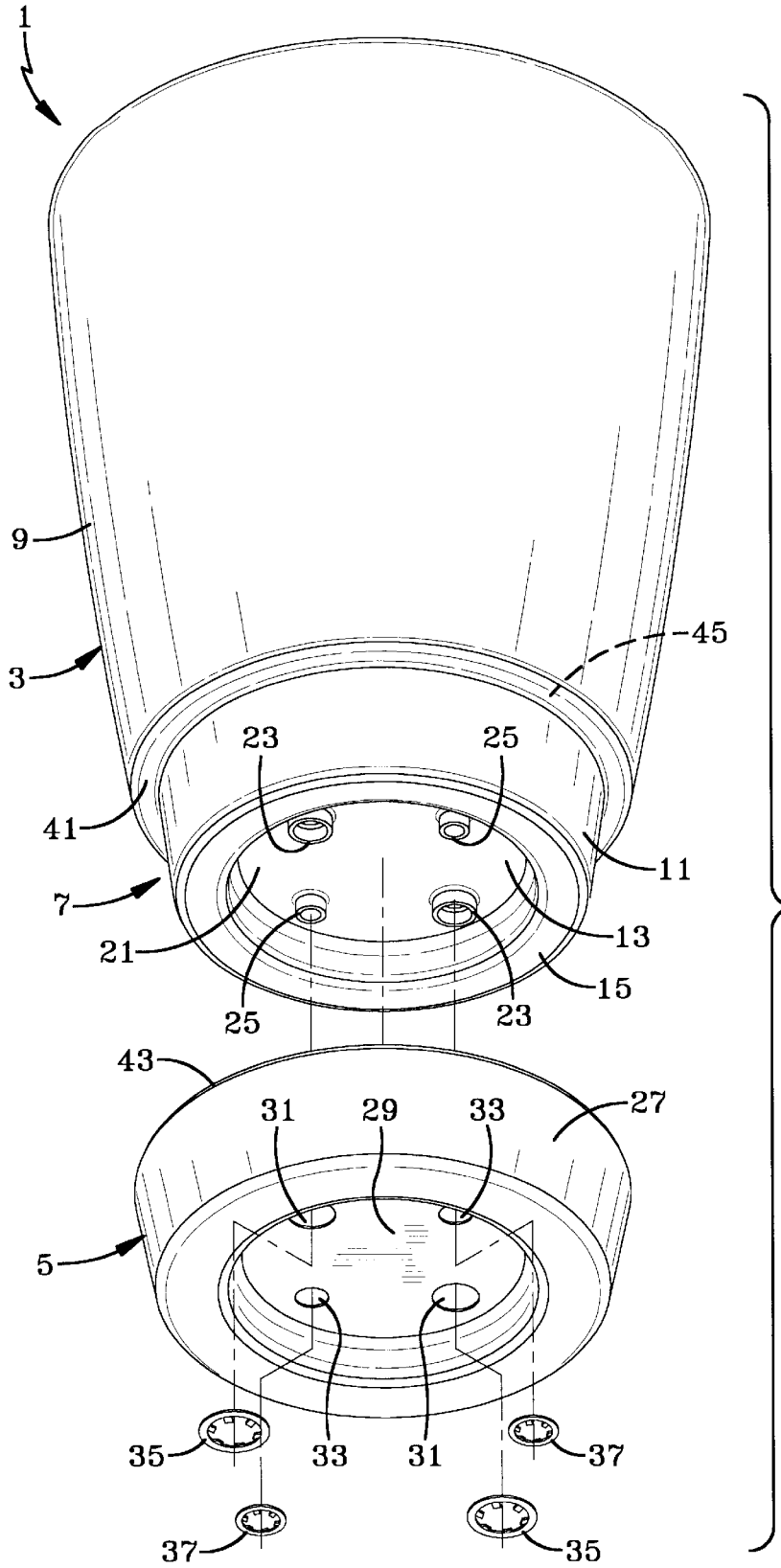
FIG. 2 is an exploded perspective view of the container shown in FIG. 1.

Referring to FIGS. 1 and 2, there is shown a container 1 having an upper container portion 3 and a base portion 5. Container portion 3 has a base section 7 and side walls 9. Side walls 9 can be of any shape, being shown here as outwardly bowed or inclined from base portion 7. Base section 7 has a lower foot section 11 which extends downwardly to assist in supporting container portion 3 in a predetermined position. Container portion 3 also includes a floor section 13 which is disposed above the supporting section 15 of foot section 11 into container portion 3. Floor section 13 has one side 19 facing upwardly into the container portion 3 (see FIGS. 3 and 4), and a second side 21 facing downwardly. Extending from second side 21 are a first set of protruding members 23 and a second set of protruding members 25. Although sets of protruding members are preferred, one protruding member could suffice in some situations.

Base portion 5 has a foot receiving portion 27 and a raised floor supporting section 29 for supporting floor section 21 of container portion 3. Floor supporting section 29 has receptacles 31 for receiving protruding members 23, and receptacles 33 for receiving protruding members 25. (If there is only one protruding member, then only one receptacle need be provided). Protruding members 23 are preferably cylindrical members having a relatively large diameter compared to that of protruding member 25, and receptacles 31 are preferably dimensioned to receive protruding members 23 in a sliding arrangement. In order to retain protruding members in place, a pair of retainer rings 35 are optionally provided, although they have not been found necessary to employ. There is a receptacle or cavity formed by the underside of floor supporting section 29 and the inner wall of the base portion 5 for receiving retaining rings 35 and 37. This cavity defines a retainer receiving bore. Likewise, protruding members 25 are also cylinders having a smaller diameter than that of protruding members 23, and floor supporting section 29 has a second set of receptacles 33 which are dimensioned to receive protruding members 25 in sliding engagement. Retaining rings 37 are provided for holding members 25 in place, and they are preferably used.

Figure 3:
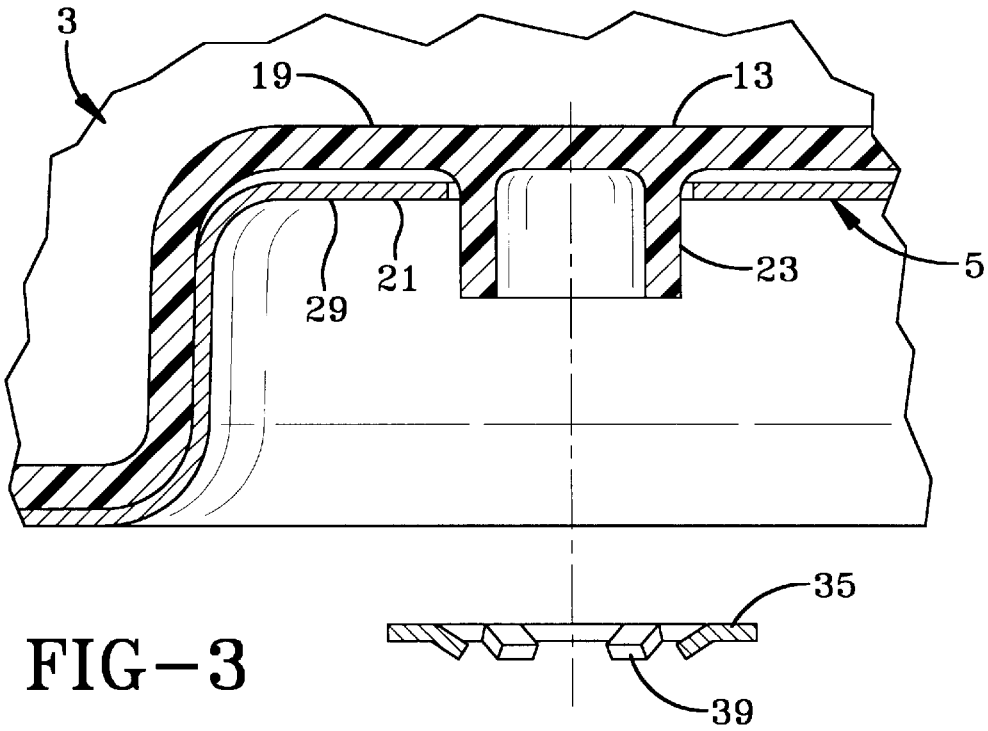
FIG. 3 is an enlarged, exploded, cross-sectional view of a portion of the container shown in FIG. 1.
Figure 4:
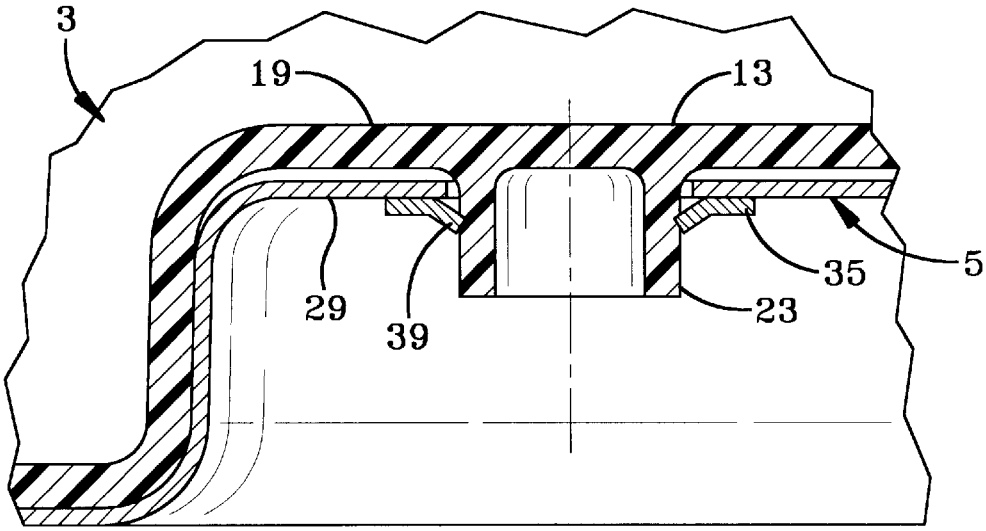
FIG. 4 is a cross-sectional view of the container portion shown in FIG. 3 with the components in assembled form.

Referring to FIGS. 3 and 4, a portion of raised floor section 13 of container portion 3 and raised floor supporting section 29 of base portion 5 are shown. As noted earlier, raised floor section 13 has side 19 facing upwardly into the container portion and a second side 21 facing downwardly. Protruding member 23 is also shown. Retaining ring 35 having inwardly directed retaining members 39 is shown in FIG. 3 as being spaced from protruding member 23. FIG. 4 shows retaining ring 35 installed on protruding member 23, with retaining members 39 engaged with the outer surface of protruding member 23 to prevent the movement of protruding member 23 with respect to floor supporting section 29. Retaining rings 37 are similarly installed on protruding members 25.

Referring to FIG. 2, side walls 9 of container portion 3 have a downwardly facing shoulder 41 on the outside of side walls 9, base portion 5 has an upwardly facing abutting surface 43 for engaging and supporting shoulder 41 and container portion 3.

As noted earlier, side walls 9 of container portion 3 are inclined outwardly, and have an inwardly facing shoulder 45 whose diameter is greater than the diameter of lower foot section 11 where it is adjacent to shoulder 41 but less than the outer diameter of 41 to enable the nesting of containers 1. That is, if one container 1 is placed inside another container 1 in a telescoping or nesting arrangement, shoulder 41 would rest on inside shoulder 45 so that the nesting containers 1 would not be jammed together, and could easily be lifted out without having to overcome the frictional engagement of the outside surface of side wall 9 and the inside surface of an outer wall 9.

Figure 5:
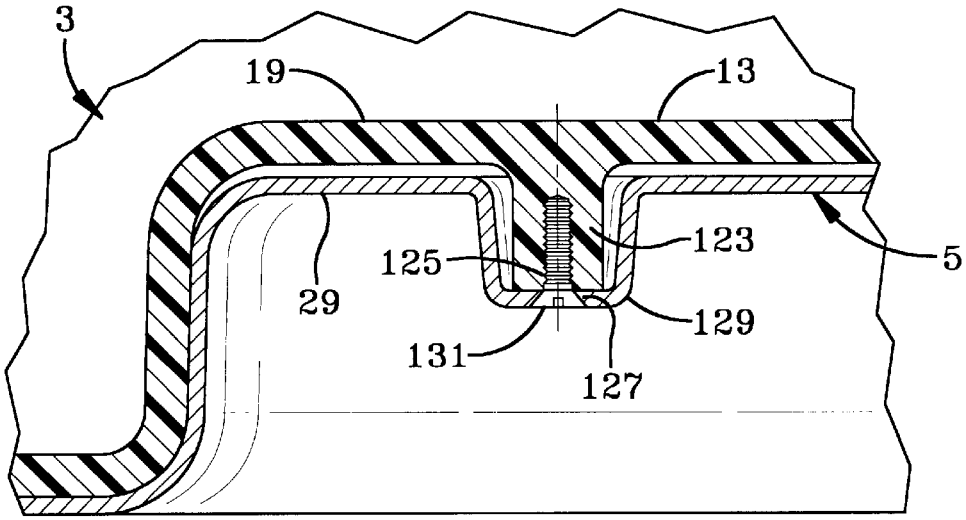
FIG. 5 is a cross-sectional view of another embodiment of a portion the container shown in FIG. 1.
Figure 6:
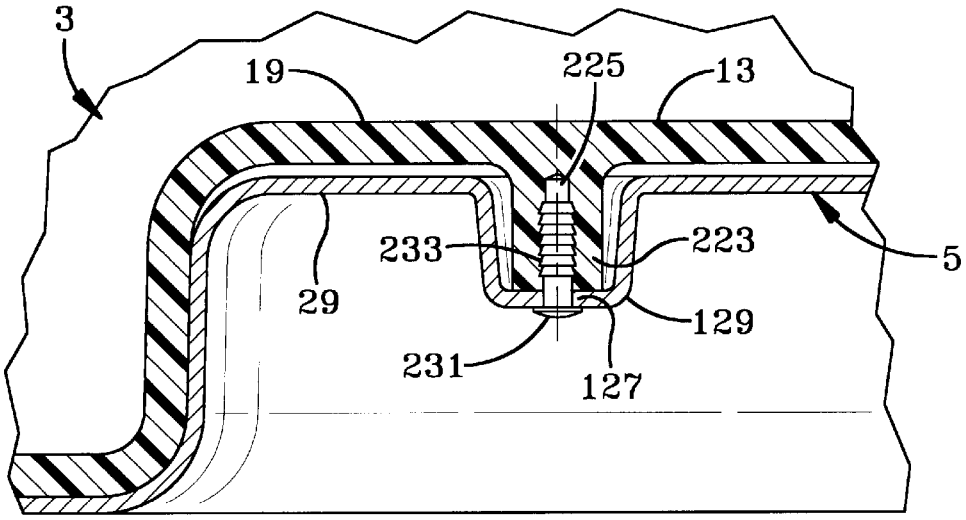
FIG. 6 is a cross-sectional view another embodiment of the container shown in FIG. 1.

Other arrangements are possible for connecting portion 3 and base portion 5, other than protruding members 23 and 25 and retainer rings 35. Turning to FIG. 5, raised floor section 13 of container portion 3 is shown, resting on base portion 5 and in particular on floor supporting section 29. However, in this case, a protruding member 123 is shown. Protruding member 123 has a screw receiving bore 125 whose axis is alignable with a hole 127 in a receptacle 129 of base portion 5. A screw 131 can be screwed into bore 125 through hole 127 in base portion 5. Bore 125 can be a smooth bore, and screw 131 can be a self-tapping screw. Bore 125 could be threaded and screw 131 can be a regular for such threaded bores. Another type of arrangement is shown in FIG. 6 where floor section 13 of container portion 3 has a protruding member 223 which rests on the same type of base portion as shown in FIG. 5, and which includes the same numbers as FIG. 5. in this case, however, a rivet 231 having retaining portions 233 is inserted into an appropriate bore 225 to hold the container portion 3 and base portion 5 together.

Figure 7:
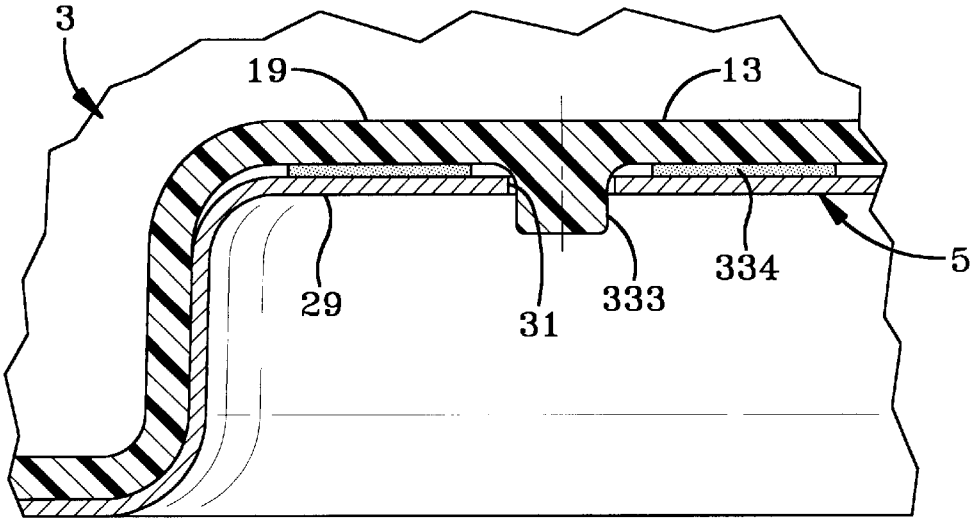
FIG. 7 is a cross-sectional view of a portion of yet another embodiment of the foregoing container.

Another variation is shown in FIG. 7. Here, floor section 13 of container portion 3 has a downwardly extending solid protruding member 333, which extends through a hole 31 in floor supporting section 29 of base portion 5. Adhesive 334 is disposed between section 29 and container floor section 13 to prevent container portion 3 and base portion 5 from becoming separated.

Figure 8:
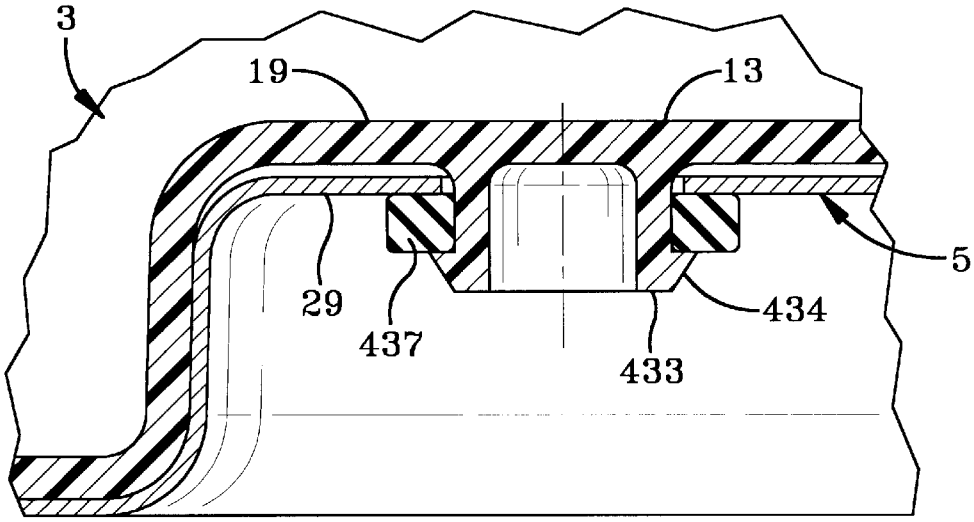
FIG. 8 is a cross-sectional view of a portion of still another embodiment of a portion of the container according to the invention.

Still a different variation is shown in FIG. 8. Floor section 13 of container portion 3 and floor supporting section 29 of base portion 5 are shown. A protruding member 433 is shown which is essentially a hollow cylinder having an outwardly extending barb-like flange 434. A flexible grommet 437 dimension to be forced over flange 434 and into the space above flange 434 and beneath floor supporting section 29 is provided. Grommet 437 is dimension to engage section 29, protruding member 433 and flange 434, to prevent container portion from wobbling on base portion 5, and to prevent separation of the latter portions.

In the foregoing description, it was stated that the protruding members would extend downwardly from container portion 3, and that the receptacle for the connecting member would be in base portion 5. A reverse arrangement is also possible, in which the protruding member would extend upwardly on base portion 5, and that the receptacle would be located in the floor section 13 of container portion 3. The arrangement could be mixed, in that both container portion 3 and base portion 5 could have protruding members extending towards the other portion, and that the other portion would have cooperating receptacles for enabling the protruding member and the other portion to cooperate to connect container portion 3 and base portion 5 together.

The preferred materials for container 1 are that container portion 3 would be made from a hard, rigid but somewhat flexible plastic and that the base portion would be made from a metal which could be chrome plated for appearance. If base portion 5 were heavier than container portion 3, this would add stability to container 1 to help prevent it from being tipped over or slid along a floor, especially when the container is loaded. Alternatively, container portion 3 could be made from plastic and base portion 5 could be made from rubber. In a variation, container portion 3 could be made from plastic and base portion could be made from glass. In another embodiment, both container portion 3 and base portion 5 could be made from plastic. In another variation, container portion 3 could be made from plastic and base portion 5 could be made from a hard, ceramic material.

Container portion 1 could be used for a variety of purposes. It could be a waste paper basket, a garbage pail, a hamper (which could have a cover over the open end of the container portion), a swing top can (which would require a top hinged to the upper part of container portion 3 and be pivotable to open and close container portion 3), a covered can or any other type of container which could be used, for example, to hold bathroom, kitchen or office items.

The invention described above has numerous advantages as discussed to some extent above. It can be easily constructed and assembled. By virtue of the metal base portion and the plastic container portion, the nesting feature described above reduces or eliminates or breaking the metal base portion and the plastic container portion. The nesting feature described above reduces or eliminates breaking during shipping. The combination of the protruding members, the receptacles and the connecting members, particularly where at least some of the protruding members are large, absorb stress should the container be dropped, to help avoid breakage.

The container shown in the drawings is elliptical, and can have a round cross section or an oval cross section. If it is round, the use of several protruding members and receptacles prevents the container portion from being rotated relative to the base portion. If it is oval, the protruding members and receptacles don't prevent rotation, but the other benefits of the invention discussed herein apply. The use of the internal shoulders for engaging the external shoulders of the shoulder portion enables nesting without jamming as noted above, and makes unnecessary the use of internal ribs which has been used in the prior art to avoid jamming. The use of a base portion made of ceramic or glass supporting a plastic container portion is helpful from safety purposes in that a lit cigarette dropped into the container might be confined to the metal base and it could not ignite the latter.

The invention has been described in detail with particular emphasis on the preferred embodiments thereof, but variations and modifications within the spirit and scope of the invention may occur to those skilled in the art to which the invention pertains.

We claim:

1. A container comprising:

an upper container portion including a base section and inclined side walls extending upwardly and outwardly from said base section, said side walls having a downwardly facing shoulder on the outside of said side walls, and said side walls extending upwardly from the base section when the base section is sitting adjacent to the ground, said base section including:

a lower foot section extending downwardly to assist in supporting the upper container portion in a predetermined position; and a raised, floor section having one side facing upwardly into the container portion and a second side facing downwardly, said raised floor section having at least one protruding member extending downwardly from said second side; and a lower base portion having a foot receiving portion for receiving said lower foot section of said container portion and a raised floor supporting section for supporting said raised, floor section, said lower base portion having outwardly inclined side walls being of the same incline as said side walls of said upper container portion whereby said side walls of said lower base portion and said side walls of said upper container portion form a continuous incline;

said floor supporting section having at lease one receptacle for receiving said at least one protruding member of said raised, floor section;

an upwardly facing abutting surface for engaging and supporting said shoulder and said container portion; and at least one retainer for cooperating with said at least one protruding member to retain said at least one protruding member in said receptacle;

wherein said at least one receptacle has a retainer receiving bore extending therethrough, said bore being aligned with said at least one protruding member.

2. A container according to claim 1 wherein said at least one protruding member is at least two protruding members, and said at least one receptacle is at least two receptacles.

3. A container according to claim 2 wherein at least one of said protruding members is relatively small in cross section and at least one of said protruding members is relatively large in cross section for absorbing stress if said container is subjected to impact.

4. A container according to claim 1 wherein said base portion has a cross section smaller than the cross section of said side walls of said upper container portion, said containers being nestable in a telescoping fashion.

5. A container according to claim 1 wherein said side walls are inclined outwardly and have an inside shoulder facing upwardly inside said container portion and facing downwardly outside said container portion, and wherein said base has a cross section for abutting said shoulder inside said container portion when said containers are nested, said base abutting said shoulder to prevent jamming during nesting of said containers.

6. A container according to claim 4 wherein said upper container portion is made of metal and said base portion is made of metal.

7. A container according to claim 8 wherein said upper container portion is made from plastic and said base portion is made from rubber.

8. A container according to claim 1 wherein said upper container portion is made from plastic and said base portion is made from glass.

9. A container according to claim 1 wherein said upper container portion and said base portion are made from plastic.

10. A container according to claim 1 wherein said upper container portion is made from plastic and said base portion is made from a ceramic material.

11. A container according to claim 1 wherein said base portion is heavier than said upper container portion to assist in preventing tipping of said container.

12. A container according to claim 1 wherein said container further comprises a retaining ring for being placed on said protruding member on the opposite side of said foot receiving section on said floor section to connect said container portion and said base section.

13. A container according to claim 1 wherein said container further comprises a screw for being inserted into said at least one protruding member from the opposite side of and in engagement with said foot receiving section or said floor section to connect said container portion and said base portion.

14. A container according to claim 1 wherein said container further comprises a rivet for being placed in said at least one protruding member on the opposite side of and in engagement with said foot receiving section or said floor section to connect said container portion and said base portion.

15. A container according to claim 1 wherein said container further comprises adhesive for being placed between said foot receiving section and said floor section to connect said container portion and said base portion.

16. A container according to claim 1 wherein said container further comprises a grommet for being placed on said at least one protruding member on the opposite side of said foot receiving section or said floor section to connect said container portion and said base portion.

17. A container according to claim 1 wherein said container consists of one of a hamper, a swing-top can and a covered can.

18. A container according to claim 1 wherein said foot section, said floor section, said foot receiving section and said floor supporting section are elliptical in cross section.

19. A container according to claim 1 wherein said foot section, said floor section, said foot receiving section and said floor supporting section are round in cross section.

20. A container according to claim 1 wherein said foot section, said floor section, said foot receiving section and said floor supporting section are oval in cross section.

* * * * *

UNITED STATES PATENT AND TRADEMARK OFFICE

CERTIFICATE OF CORRECTION

PATENT NO. : 6,439,418 B1 
DATED : August 27, 2002
INVENTOR(S) : Robert A. Immerman and Philip C. Dretzka It is certified that error appears in the above-identified patent and that said Letters Patent is hereby corrected as shown below:

Title page,
Item [73], Assignee, the city "Bolon" should be -- Solon --.

Signed and Sealed this

Eleventh Day of February, 2003

JAMES E. ROGAN
*Director of the United States Patent and Trademark Office*